United States Patent [19]

Barnes et al.

[11] 4,142,771

[45] Mar. 6, 1979

[54] CRIMP-TYPE TERMINAL

[75] Inventors: Ronald B. Barnes, Camp Hill; Stanley B. Brinser, Harrisburg; Robert C. Swengel, Jr., York, all of Pa.

[73] Assignee: AMP Incorporated, Harrisburg, Pa.

[21] Appl. No.: 671,215

[22] Filed: Mar. 29, 1976

Related U.S. Application Data

[63] Continuation of Ser. No. 515,119, Oct. 16, 1974, abandoned.

[51] Int. Cl.[2] ..... H01R 11/08

[52] U.S. Cl. ..... 339/95 R; 174/84 C; 339/276 T

[58] Field of Search ..... 339/95 R, 97 C, 98, 339/223 R, 223 S, 276 R, 276 C, 276 D, 276 F, 276 S, 276 T; 174/84 C, 90, 94 R

[56] References Cited

U.S. PATENT DOCUMENTS

| | | | |
|---|---|---|---|
| 2,800,638 | 7/1957 | Hammell | 339/95 R X |
| 2,854,648 | 9/1958 | Berg | 339/223 R X |
| 3,594,702 | 7/1971 | Frey | 339/95 R |
| 3,670,293 | 6/1972 | Garver | 339/276 T X |
| 3,761,872 | 9/1973 | Ebinger | 174/90 X |
| 3,777,051 | 12/1973 | Ziegler et al. | 339/276 T X |
| 3,798,347 | 3/1974 | Harding et al. | 339/276 RV |
| 3,812,448 | 5/1974 | Haitmanek | 339/97 C |

*Primary Examiner*—Howard N. Goldberg

[57] ABSTRACT

A crimpable terminal device in which the barrel is double walled, with the inner wall being formed from the same sheet of metal as the outer wall and being integral therewith. Specifically, the inner wall is formed by folding over extensions of the outer wall back upon the inner surface of the inner wall and then forming the resulting double thickness of metal into a barrel within which a wire is placed and the barrel crimped thereupon. The inner wall of the barrel can have slots or apertures therein or other irregular surfaces, all designed to bite into the conductor crimped therein to make good electrical and mechanical connection therewith. Because the inner wall has slots formed completely therethrough, and further because the inner wall can move relatively freely with respect to the outer wall, the crimping produces unusually good electrical and mechanical connections and with many side benefits.

59 Claims, 32 Drawing Figures

FIG. 9 A-A

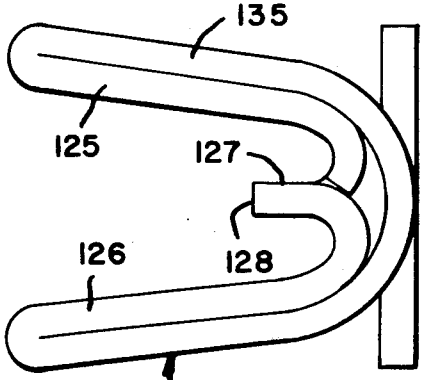
FIG. 12a
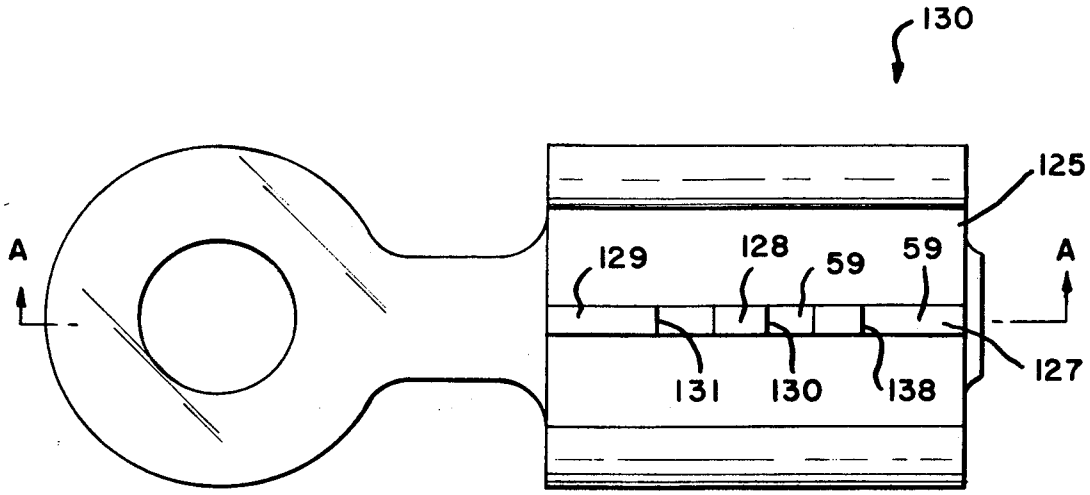
FIG. 12
FIG. 12b
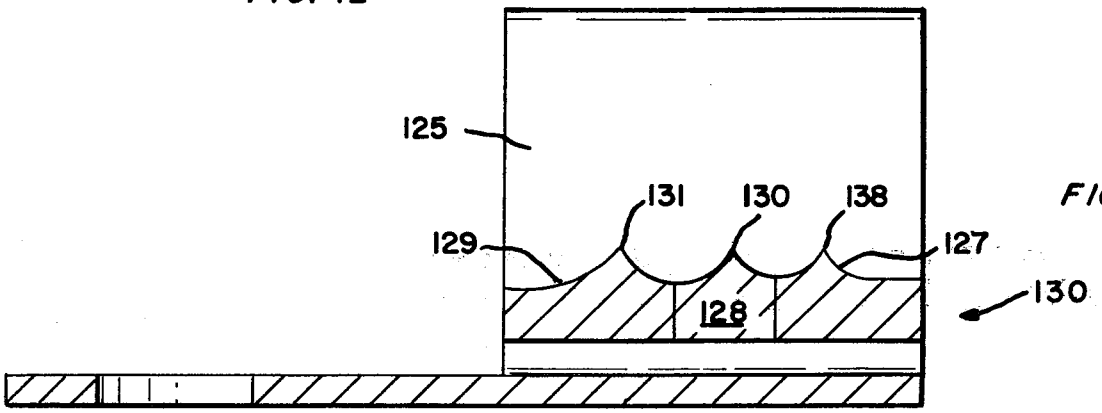
SECTION A-A

SECTION A-A OF FIG 14

CRIMP-TYPE TERMINAL

CROSS-REFERENCE TO RELATED APPLICATION

This application is a continuation of application Ser. No. 515,119 filed Oct. 16, 1974, now abandoned, by Ronald Bruce Barnes, Stanley Byron Brinser and Robert Charles Swengel, Jr. for "Crimp-Type Terminal".

BACKGROUND OF THE INVENTION

This invention relates generally to terminals for terminating wires and more particularly terminals which terminate wires by being crimped thereon.

In the prior art there are many different crimpable terminals. Almost all of these prior art crimp type terminals employ a metal barrel into which the end of a wire is laid and then the metal barrel is crimped around the wire, making both an electrical connection and a mechanical connection therewith. In most cases the connections do not require solder; the force of the crimping itself creates an extrusion of the wire therein to provide good electrical and mechanical connection.

In one of the several different types of crimps in common use today the barrel is crimped so that the cross-sectional configuration thereof is generally cardioid in shape; although somewhat flatter and is commonly referred to as an "F" type crimp. Another type crimp is circular in nature and is commonly referred to as an "O" type crimp. A third type crimp is generally flat in nature wherein the barrel is forced down upon the wire between two surfaces which are flat and substantially parallel with each other.

Many prior art crimp type terminals have serrations in the barrel which usually run circumferentially around the barrel, although other configurations are sometimes employed. Such terminals usually have other portions attached thereto, such as a ring tongue portion or a spade portion for securing to a terminal lug or bolt, for example. A problem sometimes arises when large gauge wires are to be crimped, in that a relatively large mass of metal, i.e., a heavy gauge material, is required for the barrel to properly retain the large gauge wire. However, such heavy gauge metal frequently is not required with the spade or ring tongue portion. Accordingly, considerably more material is utilized in the manufacturing of such terminals than is really needed. When millions of terminals are being manufactured, the excess material used in each terminal accumulates to a large amount and represents a substantial amount of expense. On the other hand, if the thickness of the barrel portion is reduced to the thickness required for the ring tongue portion of the terminal, then the heavy gauge wire will not be properly retained within the crimped barrel.

Another common problem is the range of wire sizes with which any given barrel size can be used. In most terminals of this type only a range of two or three gauges of wire can be crimped within a given barrel. If the barrel is too small, the wire is not properly retained, and if the barrel is too large, then the wire does not fill up a sufficient amount of the barrel cavity after crimping to provide good electrical contact and mechanical tensile strength. More specifically, in the case where the wire is too large for the barrel, the barrel tends to relax excessively, thereby reducing the effectiveness of the electrical contact as well as reducing the tensile strength.

Also, in the case of a single barrel terminal air and the corrosive elements it contains can more freely enter the crimped barrel and cause corrosive effects which decrease the effectiveness of the electrical connection and sometimes the tensile strength.

In cases where serrations are used in single thickness barrels the grooves between the ridges or serrations cannot become much wider as the crimping occurs, which places limitations on the effectiveness of the crimp. More specifically, the ridges or serrations cannot spread apart as crimping occurs because they are an integral part of the barrel. The wire, however, extrudes significantly in a longitudinal direction during crimping. Thus, there is a tendency for the edges or walls of the serrations to be crumbled by the extruding wire during crimping so that the metal of the wire is not forced down into the grooves between the serrations as completely as is desired.

While there is some spreading of the serrations of a single walled barrel during crimping, and then a springing back of said serrations towards each other after the crimping force is removed to grip the copper which has been extruded in between the serrations, such effect is deteriorated by the afore-mentioned crumbling of the edges and walls of the serrations in a single thickness barrel.

Still another problem encountered in currently used crimp type terminals is the relatively large crimping force required in order to extrude large gauge wires so that good electrical and mechanical connection is made therein. In many cases this relatively large crimping force precludes the crimping of said barrel which have had a plastic sleeve placed thereover. In such cases, crimping must be done before the plastic sleeve is placed over the terminal, which requires an extra manufacturing step.

BRIEF STATEMENT OF THE INVENTION

It is a primary object of the present invention to provide a crimpable-type terminal which substantially avoids most of the problems attendant with presently used crimp type terminals.

A second object of the invention is a crimp type terminal in which the barrel is formed of two thicknesses obtained by folding the barrel wall over onto itself and then crimping the resulting double thickness barrel upon a wire.

A third object of the invention is a crimp type terminal which requires a significantly less crimping force in order to obtain an electrical connection and a mechanical connection equal to or better than that currently used on crimp type terminals requiring a much greater crimping force.

A fourth purpose of the invention is a crimp type terminal having a double thickness barrel in which the inner wall can have serrations of various geometric configurations and in which said inner wall can move freely relative to the outer wall during the crimping process, thereby creating a superior extrusion of the copper wire between said serrations than has been known heretofore.

A fifth aim of the invention is a crimp type terminal employing a double walled barrel which can be employed with heavy wire, while other portions of the terminal, such as a spade portion or a ring tongue portion, can be of a much lighter weight material, thereby saving a large percentage of the metal ordinarily required in presently known crimp type terminals, employed with wires of the same gauge.

A sixth object of the invention is a crimp type terminal employing a double walled barrel, a given size of which is usable with a larger range of wire gauge sizes than has been known heretofore.

A seventh purpose of the invention is a crimp type terminal requiring a much smaller force to obtain a given electrical and mechanical connection than has been known heretofore, thereby permitting the crimping of the terminal barrel after a plastic sleeve has been placed around said barrel.

Another object of the invention is the improvement of crimp type terminals generally.

In accordance with one preferred form of the invention, there is provided a terminal in which the wall of the barrel portion is formed from a metal blank having two tabs extending at opposite directions from a center supporting portion, which tabs are folded about lines parallel with said center supporting section to produce two double thickness sections. These two double thickness sections are shaped into an open barrel configuration into which a receiving wire is laid, and the crimping operation subsequently performed. The barrel thus is double walled, with the inner wall being integrally connected to the outer wall, but yet being free to move relatively independently of said outer wall during the crimping operation. Furthermore, the inner wall can have slots or holes formed completely therethrough to produce, in combination with the solid outer wall of the barrel, a serrated effect, but which is relatively independent of the outer wall as crimping occurs to produce the many beneficial results set forth in the objects above. Such slots can extend circumferentially around the barrel with the metal elements between the slots acting as beams. When crimping occurs both the wire and the inner barrel extrude longitudinally. The wire is forced into the slots between the beams. When the crimping force is removed some relaxation occurs and the inner barrel contracts along its longitudinal axis, thereby moving the beams close together and gripping that portion of the wire which has been forced into the slots between said beams. In this manner an excellent electrical and mechanical connection is made between wire and terminal.

In accordance with another form of the invention a plurality of circular, oval, square, or holes of any configuration are formed in the inner wall of the barrel and crimping is then effected. This particular form of the invention is especially suitable for use with aluminum wire because of the many small pockets of aluminum which will be forced into the holes in the inner barrel during the crimping process. Upon removal of the crimping force and the subsequent springing back of the inner barrel, the edges of said holes will exert residual, spring-like forces on the pockets of aluminum retained therein, thus very substantially eliminating the connection-deteriorating effect of relaxation, which is a characteristic of aluminum. Good electrical and mechanical connection is assured.

In accordance with still another form of the invention the inner barrel wall has an axial length considerably less than that of the outer barrel wall, thereby producing a larger force per unit area on a wire crimped therein to produce a good electrical connection. The extensions of the outer barrel will also close upon the wire, but primarily for the purpose of providing good tensile strength between the wire and the terminal. The electrical connection is primarily between the shortened inner wall of the barrel and the wire.

In still another form of the invention the terminating edges of the folded over portions of the inner barrel are shaped in such a manner and abutted against each other so that one of them will move up and into the cavity of the barrel during crimping. More specifically, the inner barrel wall, having a smaller radius than the outer barrel wall, will travel farther during such crimping operation than the outer barrel wall, and one of the facing terminating ends of the two bent over sections of the inner barrel wall will ride up and over the terminating end of the other bent over portion and into the cavity of said barrel, thereby piercing the insulation of an insulated wire inserted therein to make good electrical contact therewith.

In accordance with still another form of the invention the basic sheet stock from which the terminals are formed can be bi-metallic in nature so that when the fold over of the barrel portion of the terminal occurs, both the outside wall and the inside wall is bi-metallic, with a first of the metal layers extending around the outside of the outer wall of the barrel and the inside of the inner wall of the barrel, and with the second metallic layer extending around the inner side of the outer wall of the barrel and the inner side of the inner wall of the barrel, thereby making an adjacent double thickness of said second metallic layer within single thickness layers of the first metallic layer. This last-mentioned form of the invention is particularly adaptable for applications wherein different characteristics are required to perform the functions desired in the terminal. For example, where high structural strength is required, the inner double thickness of metal can be of steel for structural strength, and the outer layer of metal can be copper or aluminum, or any other metal which will make particularly good electrical contact with the wire around which the terminal is to be crimped.

In accordance with another form of the invention the ends of the folded over portions of the barrel are bent away from the inner surface of said outer wall and into the barrel cavity. The center sections of these bent away portions are removed to produce a generally bifurcated member having two legs extending into the barrel cavity. Since there are two bent away portions involved, this arrangement results in four such legs. These four legs are divided into two pairs of legs whose major surfaces face each other within the barrel cavity and which are spaced apart a predetermined distance. Tabs are formed on the sides of each of these four legs, with all four tabs facing the center portion of the barrel and further with the two tabs connected to each facing pair of legs being bent towards each other so that their terminating edges form a slot which is vertically disposed with respect to the general longitudinal axis of the slot. Since there are two pairs of such facing tabs, two such slots are formed. The wire to be terminated is pushed down into these two slots, one of which can be designed to bite only into the insulation of the wire to provide mechanical strength, and the other of which can be designed to bite into the metal portion of the wire to provide good electrical connection. The top portion of the barrel is then crimped around and over the slots, thereby locking the wire therein.

In accordance with still another form of the invention the terminating edges of the two folded over inner wall sections are again bent away from the inner surface of the outer wall and extend into the cavity of the barrel.

These bent away portions are non-continuous in that sections thereof are removed. More specifically, sections of each of said bent away portions are removed in such a manner that the remaining parts of the bent away portion can be interleaved and will lie in a single plane or ridge which extends into the cavity of the barrel. Each of these remaining bent away parts are configured to come to a point extending into the barrel cavity and which functions to penetrate the insulation of a wire placed in the cavity barrel when the barrel is subsequently crimped around said wire.

In accordance with a feature of the invention, most of the embodiments of the invention described hereinbefore can be crimped in the form of an "F" crimp (a generally cardioid shape) and "O" crimp or a flat crimp. Furthermore, most of the modifications of the invention can have slots or apertures of different configurations formed in the inner wall of the double walled barrel.

In accordance with another feature of the invention the concept of the invention is not limited to a single fold over layer to form a double walled barrel. The folded over portion can in turn be folded back upon itself for a third layer and conceivably be folded over yet again to form a fourth layer. With such multiple folded over layers, not only can slots be formed in an inner layer, but also fingers or tangs can be formed from a middle layer and extend through the holes of that layer adjacent the inner wall of the barrel to provide various gripping and electrical connection functions. Further, with such multiple folded over structures, one of the in-between walls can be corrugated or have a waffled effect in order to provide residual spring-like effects or other characteristics to promote good electrical and mechanical connections.

BRIEF DESCRIPTION OF THE DRAWINGS

The above-mentioned and other identified objects and features of the invention will be more fully understood from the following detailed description thereof when read in conjunction with the accompanying drawings in which:

FIGS. 9 and 9*a* show a top view and end view respectively of still another form of the terminal having a double walled barrel, with the inner wall having a much shorter axial length than the outer wall, and with a portion of FIG. 9 shown in section along plane B—B of FIG. 9*a;*

FIGS. 12, 12*a* and 12*b* show a top view, an end view and a side view respectively, of still another form of the invention utilizing a double wall barrel and having interleaved and pointed portions of the terminating edges of the inner wall extend into the barrel cavity, and with a portion of FIG. 12*b* shown in section along the plane C—C of FIG. 12;

DETAILED DESCRIPTION OF THE INVENTION

Figure 1:
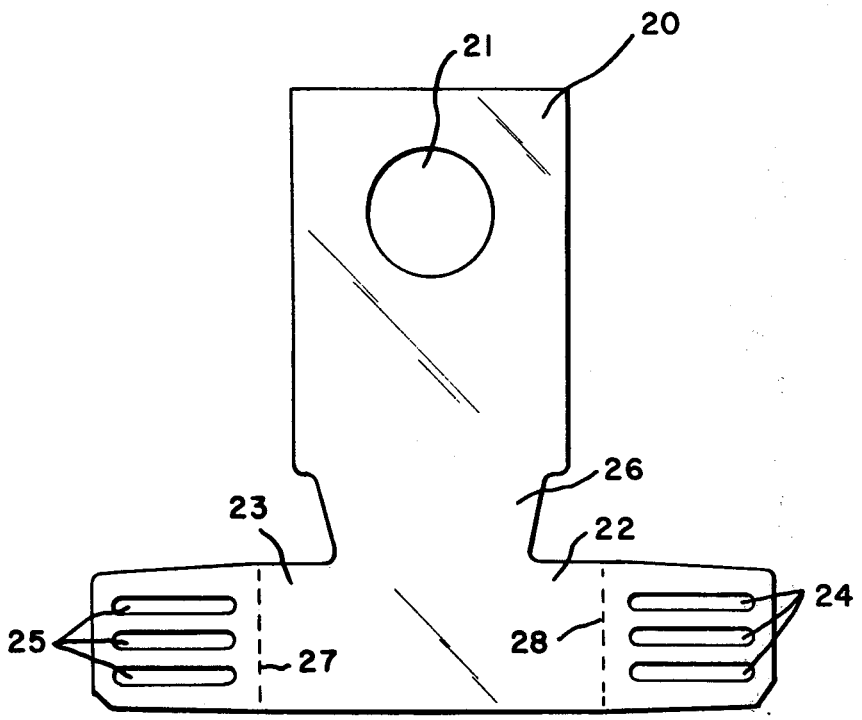
FIG. 1 shows a view of a stamped out blank of one form of the invention.

Referring now to FIG. 1 there is shown a stamped out blank of one form of the invention and comprises a section 20 having a hole 21 therein for securing the terminal to some appropriate means, such as a lug arrangement. Tab portions 22 and 23, each having three slots 24 and 25, respectively, formed therein, are connected to the flat portion 20 by a neck arrangement element 26. The two sets of three slots 24 and 25 extend completely through the tab elements 22 and 23 and are contained in portions of said tab elements 22 and 23 which are folded about folding lines 28 and 27, respectively, to form a double thickness element. This double thickness element is then molded into an open barrel arrangement 30 as shown in FIG. 2.

Figures 2, 3:
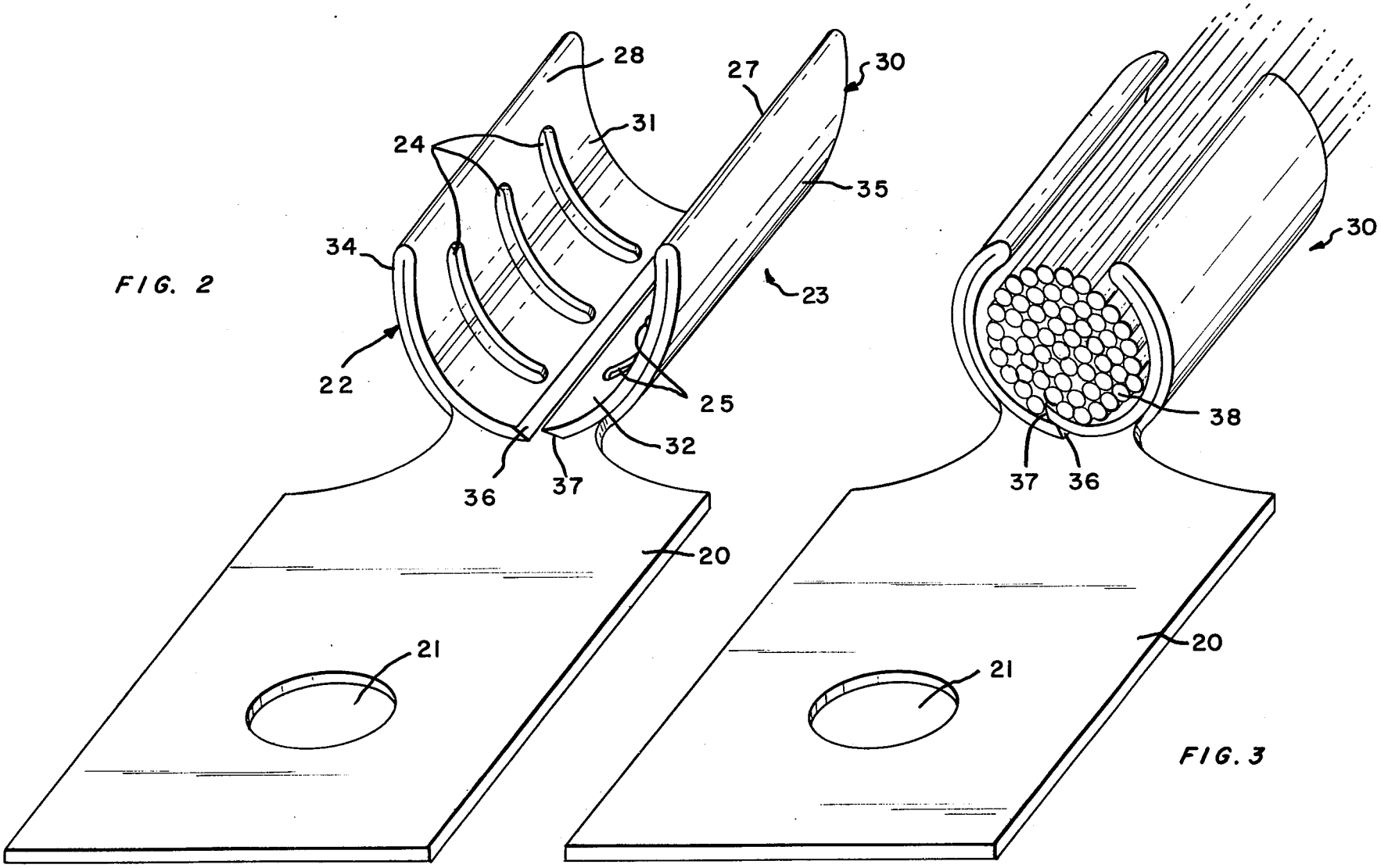
FIG. 2 shows the structure of FIG. 1 with two portions thereof having slots therein folded over to form a double walled, open barrel for receiving a wire.
FIG. 3 shows the structure of FIG. 2 with a wire placed therein and with partial crimping having occurred.

In FIG. 2 the folded over portions form the inner wall of the double walled barrel 30 and are identified in FIG. 2 by reference characters 31 and 32. That portion of the tabs 22 and 23 forming the other wall of the barrel 30 are identified in FIG. 2 by reference characters 34 and 35. The edges 36 and 37 of the folded over inside walls 31 and 32 are swaged or stamped at an angle, as indicated in FIG. 2. Such angled edges 36 and 37 are substantially parallel with each other and lie in a plane which does not pass through the longitudinal axis of the barrel. Thus, when the barrel is crimped further, and the edges 36 and 37 of the inner walls 31 and 32 move towards each other, the edge 37 will ride over the edge 36 and into the interior of the barrel, as shown in FIG. 3.

Thus, after crimping, the edge 37 will bite into the copper wire, designated generally by reference character 38 and shown as a stranded wire in FIG. 3. As will be discussed later in connection with FIGS. 15 through 15*c*, the protrusion of an edge, such as edge 37, can be made to dig or bite very deeply into the insulation of a conductor or the conductor itself, if desired.

Returning now to FIG. 3, it can be seen that edge 37 penetrates only a short distance into the cavity of the barrel 30 to make good electrical contact with the wire therein.

Figure 4:
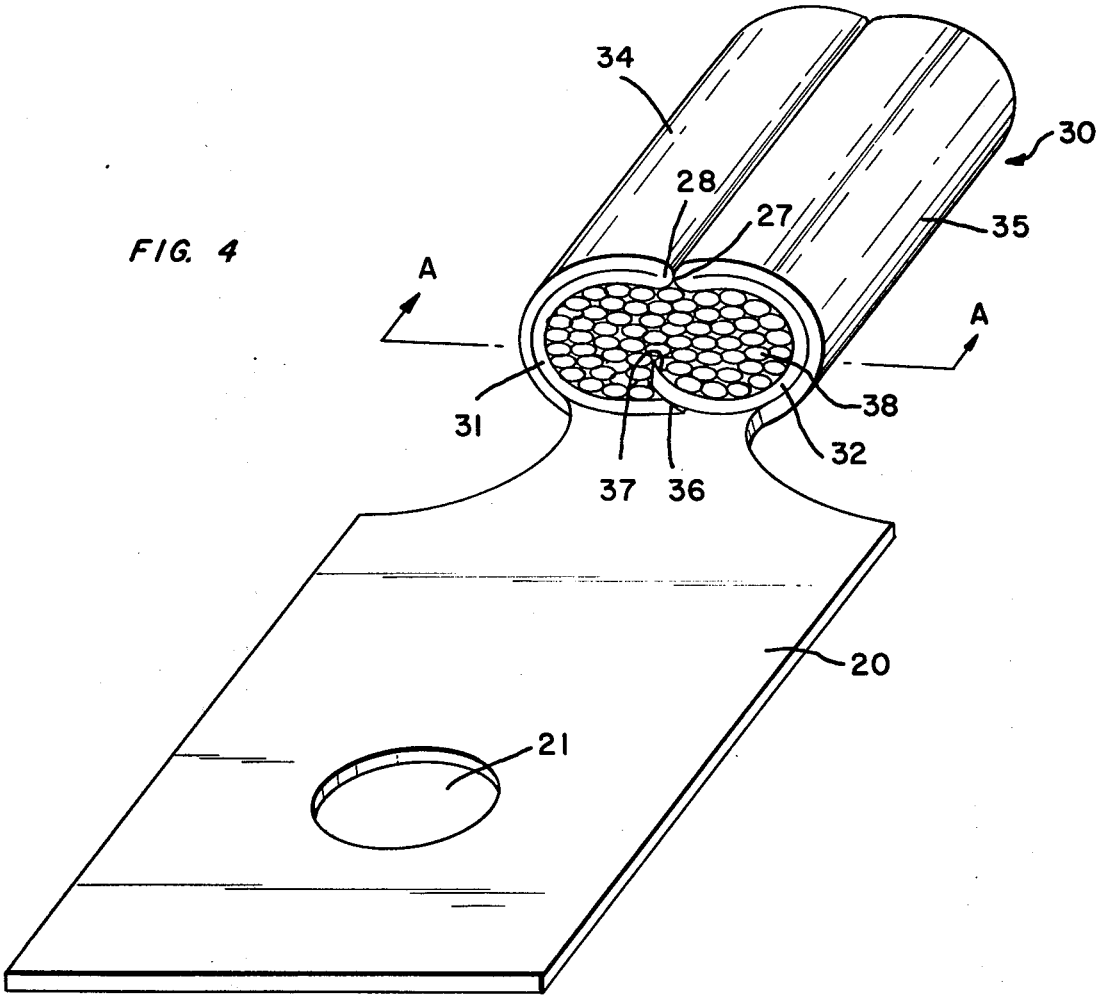
FIG. 4 shows the structure of FIG. 3 with crimping completed.

Referring now to FIG. 4 there is shown the structure of FIGS. 2 and 3 after the crimping has been completed. Because of the shorter radius of curvature, a given point on the inner walls 31 and 32 has traveled appreciably farther than a given point on the inner side of the outer walls 34 and 35 to cause the edge 37 to ride well up over the edge 36 of the inner wall 31 and into the cavity of the barrel, thereby making good electrical contact with the wire 38 therein, as discussed briefly above in connection with FIG. 3.

After the crimping force is removed, the edge 37 of the inner barrel 32 will tend to relax. However, since it has been driven up into the wire 38, any tendency of the edge 37 to relax will only tend to increase the force between it and the conductor into which it has penetrated. Furthermore, when edge 37 tends to relax, i.e., tends to spring open to a larger radius of curvature, it will put pressure upon the edge 36 of the other inner wall 31, thereby tending to bring the top portions of the barrel (along the fold over lines 27 and 28) downwardly in FIG. 4 and into the wires 38 contained therein. In other words, in the configuration shown in FIG. 4, the inner wall and the residual forces contained therein cooperate with the outer walls 34 and 35 to exert continuous and even increasing forces between the inner walls 31 and 32, and the wire 38 contained therein, as said inner walls 31 and 32 tend to relax or spring open to increase their radius of curvature. The outer walls 34 and 35 will prevent the inner walls from springing open near their terminating edges 36 and 37 since said outer wall provides a strong backing immediately adjacent thereto.

Any tendency of the overall structure to open up upon the removal of the crimping force will tend to drive the penetrating edge 37 further into the wires 38, thereby increasing the effectiveness of the electrical connection between the inner barrel and the wires 38 contained therein.

Figure 5:
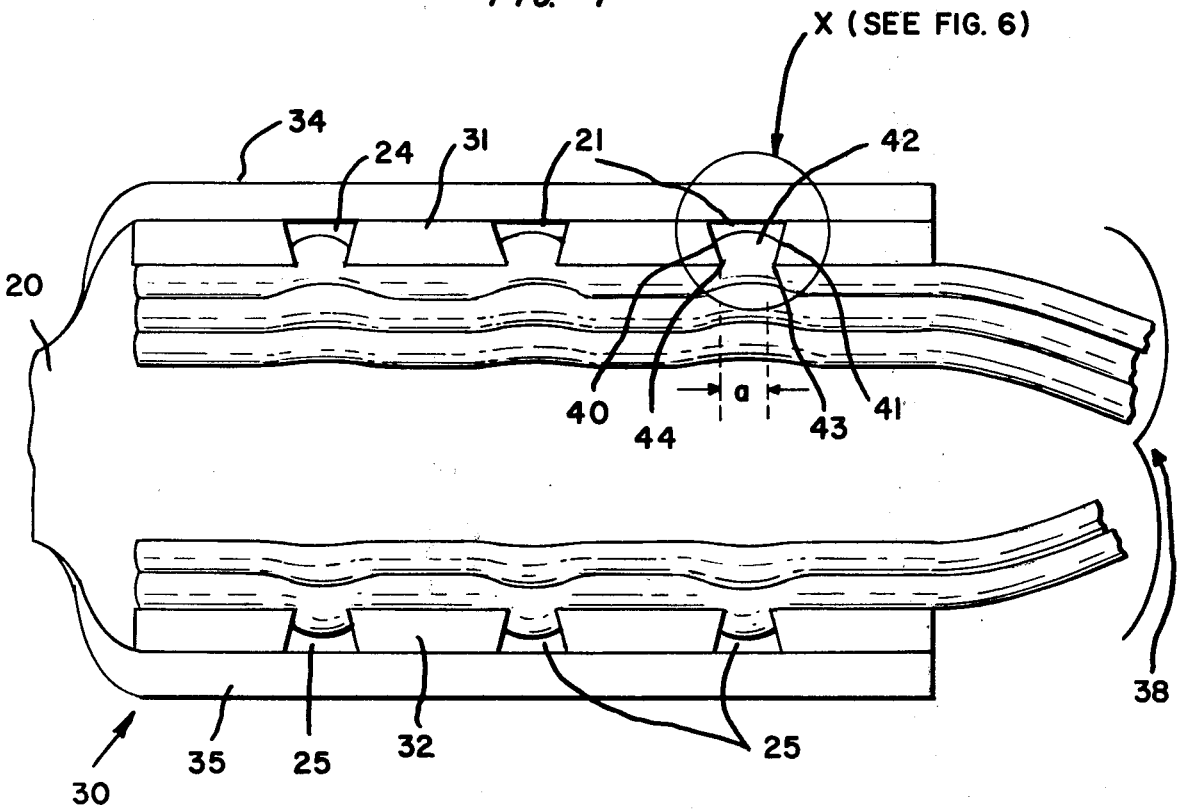
FIG. 5 is a sectional view of FIG. 4 taken along the plane A—A.

Referring now to FIG. 5 there is shown a view of the cross sectional area taken along the plane A—A in FIG. 4. More specifically, FIG. 5 shows generally the relationship between the crimped wires 38 and the grooves 24 and 25 on the inner walls 31 and 32 of the double wall barrel 30. It can be seen that the copper wires are forced into the grooves 24 and 25, which can have tapered walls so that the edges of the grooves facing the cavity of the barrel will more effectively grip the copper wires 38 forced therein.

More specifically, reference is made to the encircled portion X of the cross-sectioned slot or groove 24 in FIg. 5. Walls 40 and 41 are flared outwardly when viewed from the cavity of barrel 30. Thus, when the crimping occurs, a portion 42 of conductor 38 is forced into the slot 24 and the sharp edges 43 and 44 of slot 24 combine with the angled walls 41 and 40 to provide both a means for biting into the copper wire forced therein and also a shoulder means which will retain the copper forced therein to prevent the wire from being pulled from the terminal, i.e., to provide a high tensile strength between the terminal and the wire it contains.

Figure 6:
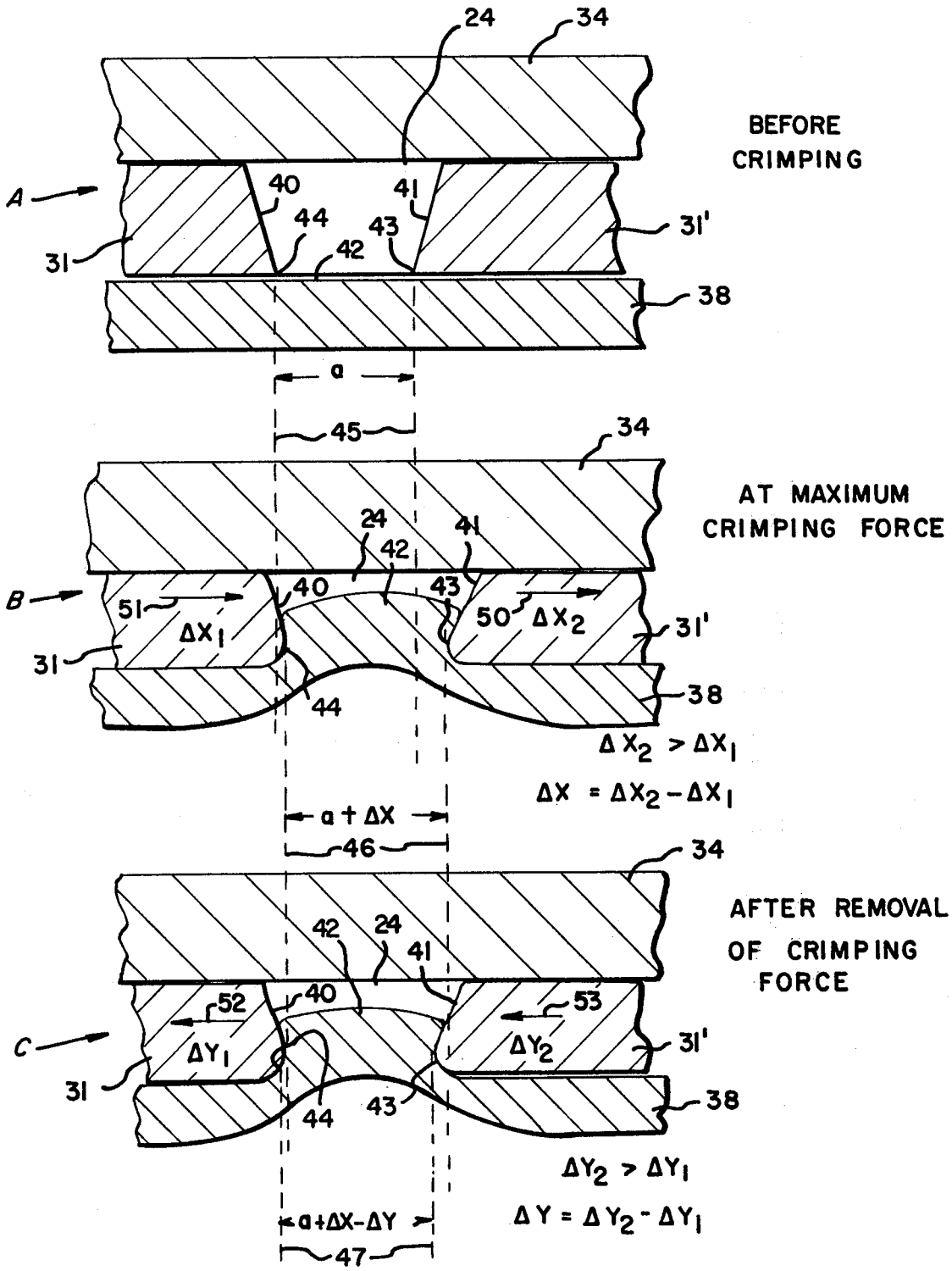
FIG. 6 shows an enlarged view of the detail of FIG. 5 within the circle X before, during and after crimping.

Referring now to FIG. 6 there is shown the encircled portion X, both before crimping in view A, at maximum crimping force in view B, and after removal of the crimping force in view C. View C in FIG. 6 is an enlarged view of the encircled portion X in FIG. 5. Views A and B represent the same encircled portion X in FIG. 5, but before crimping and at maximum crimping force, as discussed above.

In view A of FIG. 6 it can be seen that the edges 43 and 44 of groove 24, which edges face the interior of the barrel cavity, are spaced apart a distance "a" between the dotted lines 45, and are relatively sharply defined.

In view B of FIG. 6, at maximum crimping force, the inner barrel 31 has been elongated so that the groove 24 has actually become wider and the edges 43 and 44 are now spaced apart the distances $a + \Delta X$, as identified by the pair of dotted lines 46.

It is to be noted that the right hand end 31' of the inner wall has moved to the right in the direction of the arrow 50 by distance $\Delta_2$, whereas the left hand portion 31 of the inner wall has moved in the right hand direction of arrow 51 by a lesser distance $\Delta X_1$.

The reason why the right hand portion 31' of the inner barrel has moved in the right hand direction further than the left hand portion 31 of the inner barrel is because the encircled portion X of FIG. 5 selected for discussion in FIG. 6 is, in fact, located at the right hand end of the crimped barrel 30, as can be seen in FIG. 5. Thus, the elongating extrusion effect, which originates essentially from the center of the barrel 30 of FIG. 5, moves outwardly in opposite directions therefrom.

Referring again to View B of FIG. 6, it can be seen that the copper wire 38 has been forced into the groove 24 at maximum crimping force, and during such extrusion thereon, has rounded the edges 44 and 43 of the groove 24.

After removal of the crimping force, as shown in View C of FIG. 6, the two sections 31 and 31' of the inner wall relax somewhat and move back towards each other to become spaced apart a distance $a = \Delta X - \Delta Y$, which is the distance between the dotted lines 47. The distance $\Delta Y$ is equal to $\Delta Y_2 - \Delta Y_1$, the distances the portions 31' and 31 of the inner wall relax, in the direction of arrows 53 and 52, respectively, after the crimping force has been removed. The distance $\Delta Y_2$ is slightly greater than the distance $\Delta Y_1$ due to the fact that portion 31' of the inner wall was moved to the right further in View B of FIG. 6 at maximum crimping force and therefore will relax to the left a greater distance than portion 31 after removal of said crimping force.

Accordingly, since $\Delta Y_2$ is greater than $\Delta Y_1$ the edges 44 and 43 of inner barrel portions 31 and 31' come together slightly and apply a pressure against the portion 42 of the copper wire 38 which has been forced into the slot 24. In this manner, the copper wire 38 is held securely within the slot 24 to provide good electrical contact and good tensile strength between the wire and the terminal barrel. It is to be understood that only one wire 38 is shown as being forced into the slot or groove 24. In actual practice, where stranded wire is used, many strands of such wire adjacent the slots, such as slot 24, are forced into the slot in the manner shown in the three views A, B and C of FIG. 6.

Figure 7A:
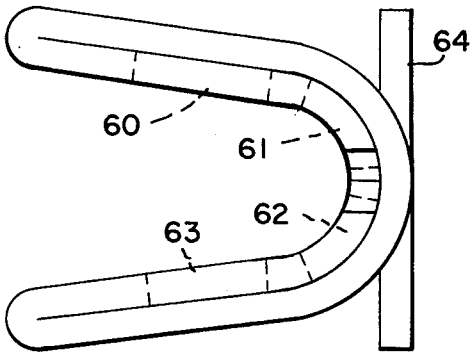
FIGS. 7, 7*a* and 7*b* show a top view and end views before and after crimping of another form of a terminal having a double walled barrel, and having a number of circumferentially disposed slots in the inner wall.
Figure 7B:
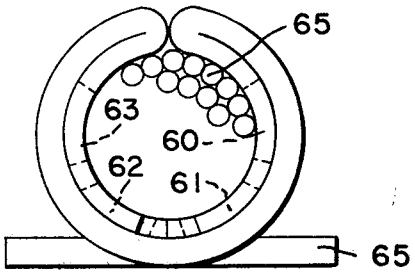
Figure 7:
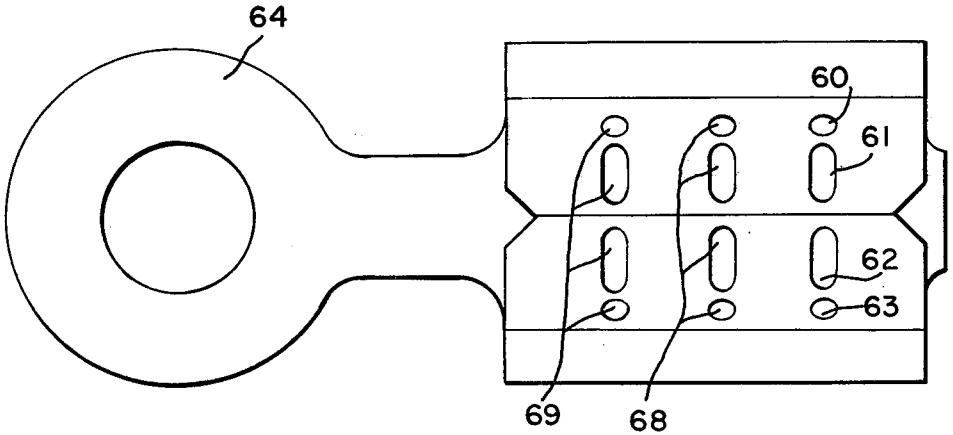

Referring now to FIGS. 7, 7*a* and 7*b* there is shown a form of the invention which is particularly adaptable for heavier conductors and which is also adaptable to be crimped into an "O" style crimp, as shown in FIG. 7*b*, wherein the interior of the cavity is generally "O" shaped after crimping.

The principal distinction between the terminal of FIGS. 1 through 6 and the structure is FIGS. 7 through 7*b* is that the latter structure has three sets of four slots each arranged circumferentially around the barrel 59. For example, slots 60, 61, 62 and 63, as shown in FIGS. 7 and 7*a*, are arranged circumferentially around the barrel 59. Two other sets of four serially arranged slots are also formed in the inner wall of the barrel 59, as shown in FIG. 7. The said other two sets of four slots are identified by reference characters 68 and 69.

While the terminal of FIGS. 7 through 7*b* is particularly adaptable to an "O" style type crimp, it can also be "F" crimped around a conductor. Both the "O" and the "F" type crimps, and also a flat crimp, can be used with the barrel of FIGS. 7 through 7*b* around either a stranded wire or a solid wire. A ring tongue terminal 64 is shown attached to the barrel 59, although any other different types of terminals can be employed in lieu of the ring 64.

Figure 8A:
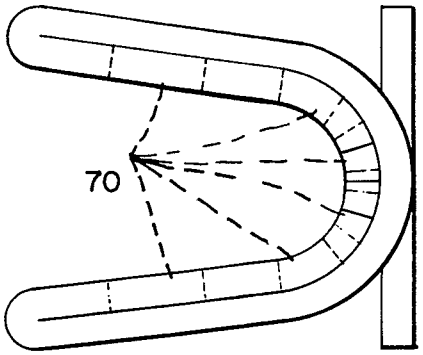
FIGS. 8 and 8*a* show a top view and an end view respectively of still another form of the terminal having a double wall barrel in the open barrel condition, and having a large number of holes in the inner wall.
Figure 8:
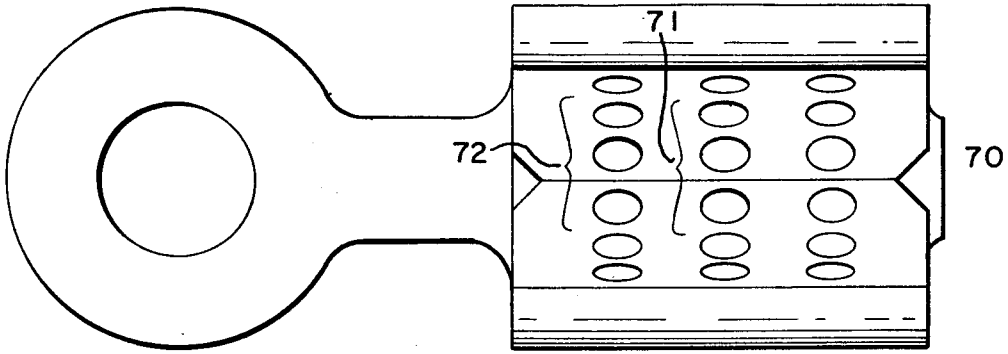

Referring now to FIGS. 8 and 8*a* there is shown a form of the invention wherein the inner barrel wall elements 66 and 67 have a larger number of holes formed therethrough. More specifically, in the top view of the terminal shown in FIG. 8 there is shown three sets of holes 70, 71 and 72 formed in the inner barrel elements 66 and 67, with each set of holes being comprised of six holes formed circumferentially around said inner wall elements. For example, the location of one group of such holes 70 is shown in FIG. 8*a* which is the end view of the terminal of FIG. 8. A ring tongue element 39 is shown attached to the barrels of FIG. 8 and 8*a*.

The larger number of holes of FIGS. 8 and 8*a* is especially adaptable to aluminum wire, for example, which has a tendency to relax more than copper and in fact, over a period of time, to flow away from any point of pressure. Therefore, by forming a large number of holes in the inner barrel, which holes can be circular, star shaped, rectangular or square, or almost any configuration, the number of points at which the aluminum will be forced into the inner barrel is increased and the grip on the aluminum wire is also accordingly increased, thereby insuring a more permanent electrical and mechanical connection between the connector and the aluminum conductor. The structure of FIG. 8 can be used also with copper wire, either solid or stranded as well as aluminum wire, either stranded or solid. Any type crimp can be employed with the terminal of FIG. 8.

Figure 9A:
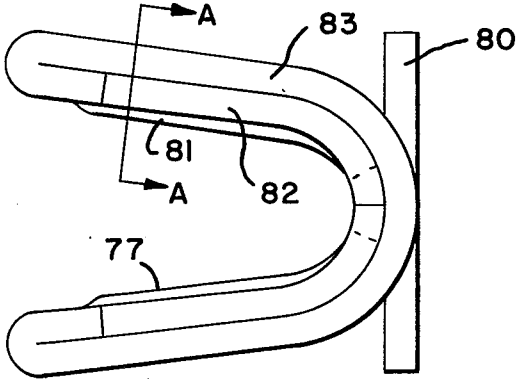

Referring now to FIGS. 9 and 9*a* there is shown a form of the invention in which the longitudinal length of the inner barrel 76 is considerably shorter than the longitudinal length of the outer barrel 83. The two sections 82 and 89 of the inner wall of the barrel have holes 79 and 78 formed therethrough to provide the general function of receiving portions of the aluminum wire therein when crimping occurs to produce the good electrical connection and the good mechanical connection described hereinbefore with other embodiments of the invention.

The cross-hatched portion of FIG. 9 is taken along the plane A—A of the end view shown in FIG. 9*a*. In the sectioned portion of FIG. 9 it can be seen that the inner barrel 76 is cold worked to present a convex surface 81 to the inner cavity of th barrel. Furthermore, it can be seen that the sidewalls 86 and 85 defining the hole 79 are formed at an angle and extend outwardly away from each other as the depth of the hole 79 increases toward the inner surface 75 of the outer wall 83 of the barrel. Thus, those edges 107 and 109 of the hole 79 which are adjacent the inner cavity of the barrel present sharp edges to a wire crimped therein, much as was discussed in connection with the edges 43 and 44 of the slots 24 of FIG. 6. The fact that the walls 86 and 85 slant outwardly as they extend away from the inner cavity of the barrel provides an improved gripping action upon the aluminum or copper wire forced therein in the same manner as discussed in connection with the slots 24 of FIG. 6.

The convex surface formed by the top surfaces 81 and 77 of the inner barrel 76 of FIG. 9 can be seen from the end view of FIG. 9*a*. The line 88 in FIG. 9 represents the point at which the folded over inner wall of the barrel, consisting of portions 89 and 82, meet at the bottom of the barrel trough. The surfaces 73 and 74 show the cross sectional configuration of the inner barrel.

In FIG. 9 a ring tongue portion 80 is connected to the barrel, although it is to be understood that many different types of terminals can be substituted in lieu of the ring tongue portion 80.

Figure 10A:
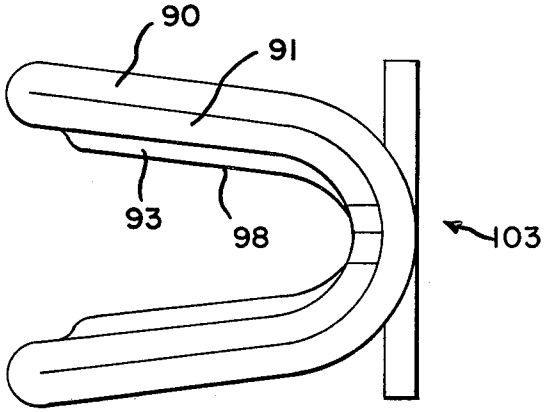
FIGS. 10 and 10*a* show a top view and an end view respectively of another embodiment of the invention having a double wall barrel with circumferentially disposed slots and rotated beams formed in the inner wall, and with a portion of FIG. 10 shown in section along plane F—F of FIG. 10*a;*
Figure 10:
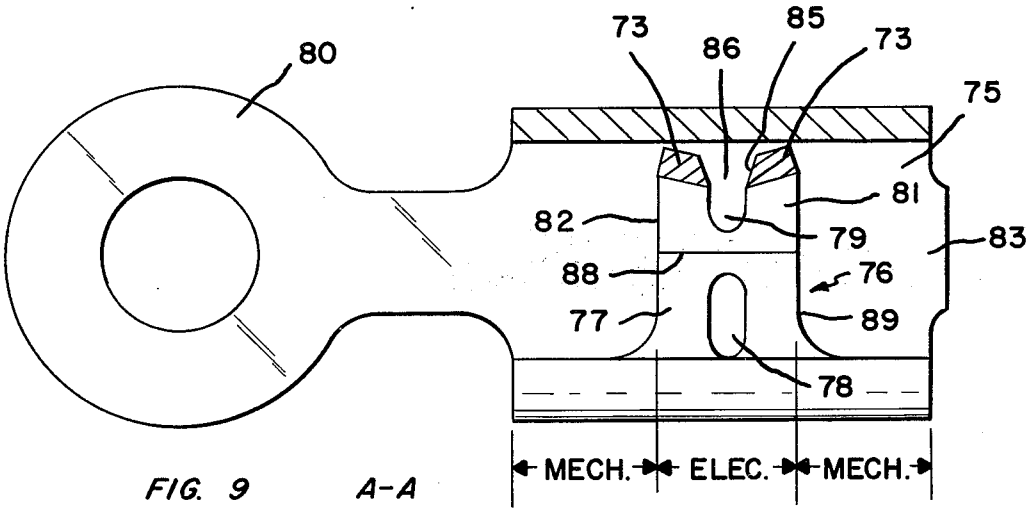
Figure 10:
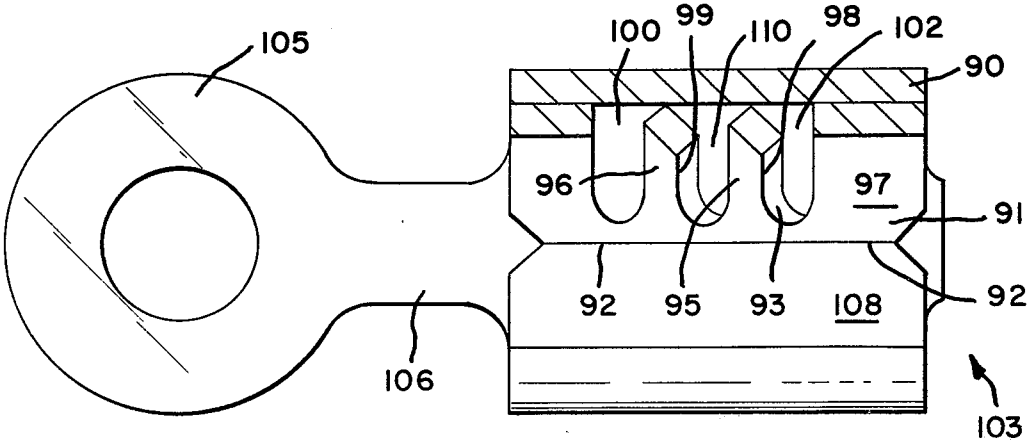

Referring now to FIGS. 10 and 10*a* there is shown a form of the invention in which preloaded annular beams 95 and 96 are formed in the inner wall 90 of the barrel 103 by cutting slots 100, 101 and 102 in said inner wall 97 and then bending the beams 95 and 96 angularly about their axes to produce the result shown in FIG. 10. More specifically, annular beams 96 and 95 are bent in a rotational manner about their longitudinal axes so that the edges 99 and 98 of said beams 96 and 95 extend outwardly into the interior cavity of the barrel. These sharp edges 99 and 98 dig into the metal of the wire crimped therein, when crimping is done. During crimping, the beams 96 and 95 are forced back towards the outer wall 90 of the barrel and are forced to rotate in a counter-clockwise direction because of the force exerted upon the edges 99 and 98 thereof. Then after the crimping force is removed, and because of the elasticity of the beams 96 and 95, said beams 96 and 95 tend to rotate back outwardly in a clockwise direction so that the sharp edges 99 and 98 maintain a preloaded force against the wire which has been crimped within the barrel 103.

The two folded over portions 97 and 108 of the inner wall of the barrel meet at the line 92, as indicated in FIG. 10. A ring tongue portion 105 is joined to the main barrel 103 by neck portion 106. It is to be understood that many other types of terminating means can be used other than the ring tongue portion 105 shown in FIG. 10.

Figure 11A:
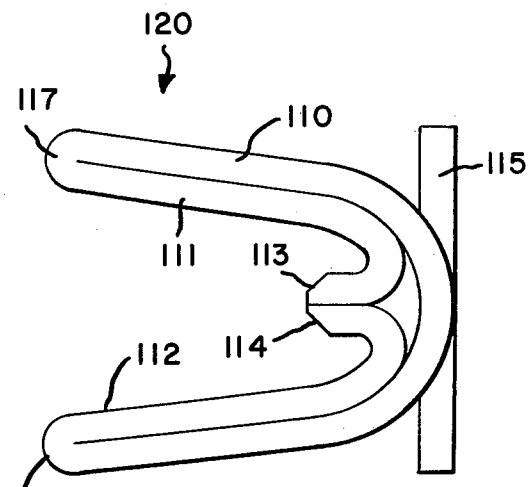
FIGS. 11, 11*a* and 11*b* show a top view and two end views, before and after crimping, of another embodiment of the invention having a double walled barrel with the terminating ends of the inner wall sections extending into the barrel cavity.
Figure 11B:
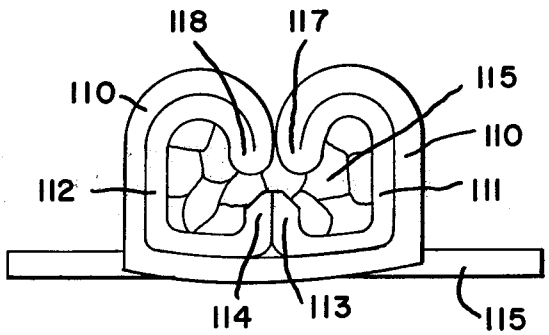
Figure 11:
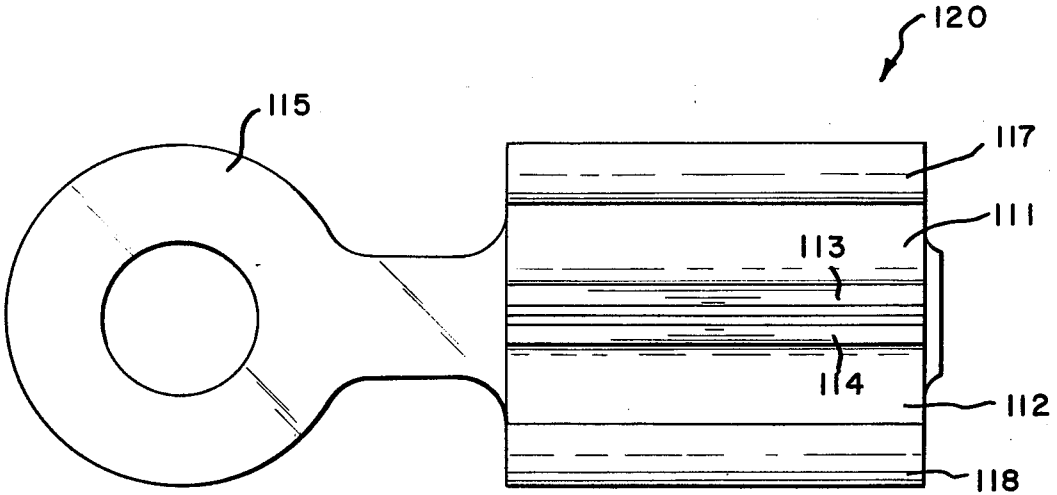

Referring now to FIGS. 11, 11*a* and 11*b* there is shown a form of the invention in which the ends of the folded over portions of the inner barrel are designed to bite deeply into the wire crimped therein, particularly in an "F" crimp. In FIG. 11*a*, the inner fold-over walls 111 and 112 of barrel 120 have terminating ends 113 and 114 which are bent away from the inner surface of the outer wall 110 and inwardly into the interior cavity of the barrel 120. The top view of FIG. 11*a* is shown in FIG. 11.

In FIG. 11*b* there is shown an end view of the barrel after a stranded wire 116 has been placed therein and an "F" crimp done. The "F" crimp causes the folded over portions 117 and 118 of the barrel 120 to penetrate downwardly and deeply into the wire 116 and against the oppositely directed force produced by the bent away terminating edges 113 and 114 of the folded over inner portions 111 and 112 of the inner wall.

In summary, the folded over portions 118 and 117 and the ends 114 and 113 result in a configuration with considerable residual forces remaining therein. More specifically, as the folded over portions 118 and 117 tend to relax they exert a force against each other to inhibit such relaxation. Further, the forces between the two bent away portions 114 and 113 of the folded over inner barrel sections 111 and 112 are considerable since the inner portions 111 and 112 are bent around a smaller radius than the outer wall 110, thereby tending to cause the inner folded over walls 111 and 112 to curl up into an even smaller radius. Thus, the inner walls 111 and 112 tend to maintain a constant spring-like force against the wires 116 contained therein. Accordingly, as the metal of the contained wires flow or relax, the inner walls 111 and 112 will tend to follow the smaller cross sectional area of the relaxing metal of the conductors to maintain a constant force thereagainst. In this manner good electrical and mechanical connection is maintained by the structure of FIGS. 11 through 11*b*. A ring tongue terminal 115 is shown connected to barrel 120. Other type terminals can also be employed.

Referring now to FIGS. 12 through 12*b*, the structure shown is somewhat similar to that of FIG. 11 in that the ends 127, 128 and 129 of the inner walls 125 and 126 of barrel 130 are bent upwardly and away from the inner surface of the outer wall 135, as shown in FIGS. 12*a* and 12*b*. More specifically, the inner wall section 126 has bent-away portions 129 and 127 as shown in FIG. 12*b*, whereas the other inner wall section 125 has only one bent-away portion 128, also shown in FIG. 12*b*, and which is positioned between the two previously mentioned bent-away portions 127 and 129 of folded over inner wall portion 126.

All three of the bent-away portions 129, 128 and 127 have peaks 131, 130 and 138, as shown in FIG. 12*b*. These sharp peaks 131, 130 and 138 function to bite into a wire which is crimped within the barrel. Such wire does not necessarily have to be a bare metallic wire since the points 131, 130 and 128 can function as insulation piercing elements.

As is true in the case of all of the other embodiments of the invention described herein, the inner walls 125 and 126, after making contact with the wire placed therein, are protected from the outside environment and its associated corrosive characteristics because they are completely enclosed in a solid outer wall 135.

Figure 13A:
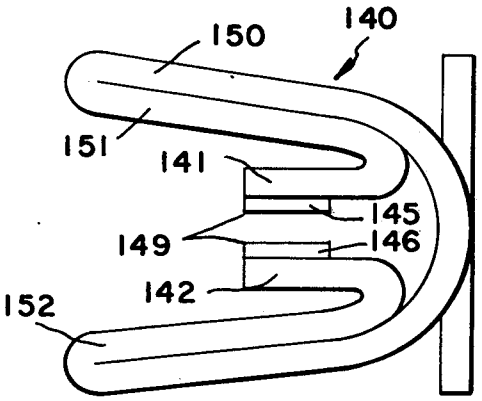
FIGS. 13 and 13*a* show a top view and an end view of yet another form of the invention employing the double walled barrel with the terminating ends of the inner wall extending into the barrel cavity and having tabs thereon which form a pair of slots into which a wire is pushed to provide both mechanical and electrical connections.
Figure 13:
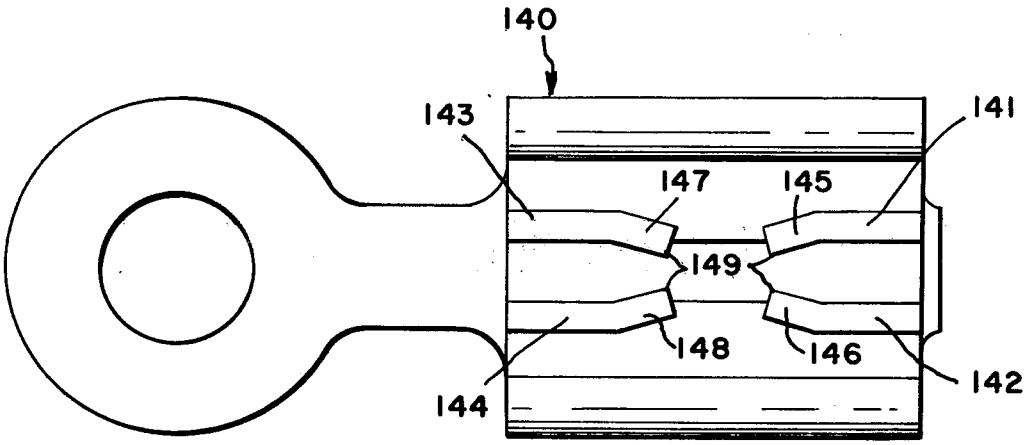

Referring now to FIGS. 13 and 13*a* there is shown a form of the invention in which the inner wall portions 151 and 152 of FIG. 13*a* have their terminating end portions 141 and 142 bent away from the inner surface of outer barrel wall 150 and extending into the interior of the barrel 140.

The terminating ends of the inner walls 151 and 152 in fact have four terminating end portions or legs 141, 142, 143 and 144, as shown in FIG. 13. These four legs 141–144 are formed by removing the center portion of the terminating ends. The purpose of creating the four legs 141–144 is to provide for tabs 145, 146, 147 and 148 to be formed thereon. These four tabs 145–148 are formed into two pairs. More specifically, tabs 145 and 146 form a pair of tabs which are bent towards one another so that their sharp edges 149 form a slot disposed vertically to the axis of the barrel 140. Similarly, tabs 147 and 148 are bent towards each other so that their sharp edges 149 form a slot which is vertically disposed to the axis of the barrel 140. The sharp edges 149 defining said two slots function to cut into the insulation of a wire forced down therein and in fact to bite into the metal wire contained in the insulated conductor. Alternatively, the wire need not be insulated but can be inserted in between the two pairs of bent together tabs 145 through 148 and with the edges 149 biting directly into the bare metal of the wire.

In a modification of the structure of FIG. 13, one pair of the facing sharp edges 149 can be closer together than the other pair of facing sharp edges 149. The aforementioned spacing can be such so that the wider spacing functions only to grip the insulation of an insulation wire or conductor, whereas the closer spread pair of sharp edges 149 can be designed to bit completely through the insulation and into the metal of the wire, thereby making a good electrical connection.

When the barrel 140 is finally crimped over on top of the wire which has been forced down in between the two pairs of tabs 145 to 148 it will retain the conductor therein and, as in the case of the previous forms of the invention, will provide excellent protection against outside environmental corrosive forces.

Figure 14B:
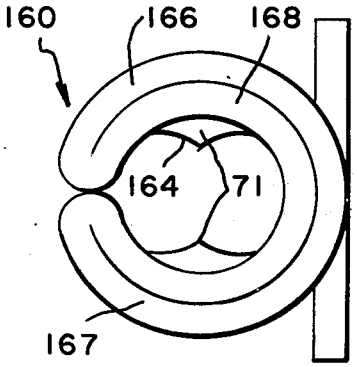
FIGS. 14, 14*a* and 14*b* show another embodiment of the invention utilizing chevron-shaped slots and with the barrel completely closed to form an "O" shaped crimp configuration, and with FIG. 14*a* being shown in section along the plane D—D of FIG. 14.
Figure 14:
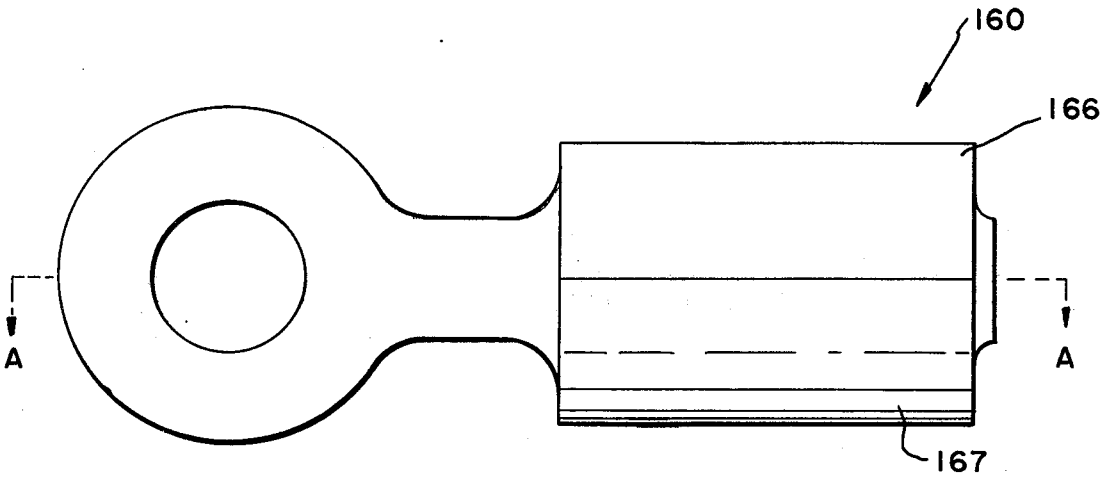

Referring now to FIGS. 14 through 14*b*, there is shown a form of the invention in which the inner barrel has a pair of chevron slots formed in each of the folded over portions 167 and 168 of the inner barrel, which meet at junction 71 (see FIG. 14*b*). One pair of such chevron slots is shown in FIG. 14*a* and identified by reference characters 161 and 162 and separated by a chevron-shaped beam 163 positioned therebetween.

Figure 14A:
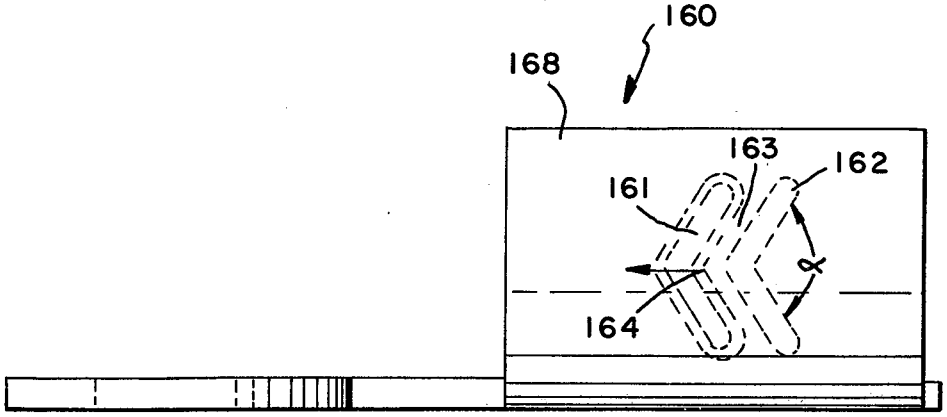

During the crimping operation the angle $\alpha$ between the two halves of the chevron slots, as shown in FIG. 14*a*, decreases sharply, thereby forcing the apex 164 of the inner connecting beam 163 forward in the direction of arrow 185 and, due to internal stresses therein, into the interior cavity of the barrel 160, as shown in FIG. 14*b*.

The apex of said beam 163 will bite into the insulation of an insulated conductor crimped within the barrel or, in the case of a non-insulated barrel, will bite directly into the metal of a conductor crimped therein.

As in the case of all of the modifications or forms of the invention shown herein, residual forces remain in the interior wall barrel largely because of the supporting structure of the outer barrel 166.

More specifically, the chevron-shaped slots 162 and 163 will receive copper forced therein, and the apex 164 of the beams 163 will be forced into the wire crimped therein, both functions creating residual forces. After the crimping force is removed, the width of the chevron slots tend to narrow, as discussed in connection with FIGS. 1 through 6, thereby gripping the conductor metal forced therein even more securely. Further, the apex 164, which has been forced into the wire, will tend to retract from the wire but due to the angle at which it entered the wire, said apex 164 will be difficult to retract from the wire without exerting a residual spring-like force against the wire of said conductor.

Figure 15:
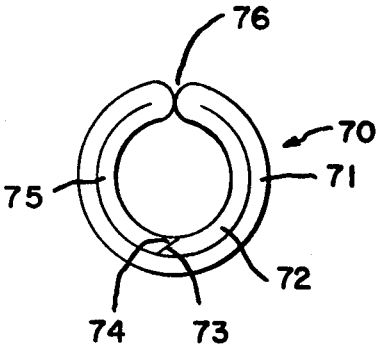
FIGS. 15, 15*a*, 15*b* and 15*c* show four stages in the construction of another form of the invention wherein the inner wall of the double walled barrel is caused to enter the barrel cavity and penetrate the insulating sheath of conductor and make contact with the solid or stranded wire contained therein.
Figure 15A:
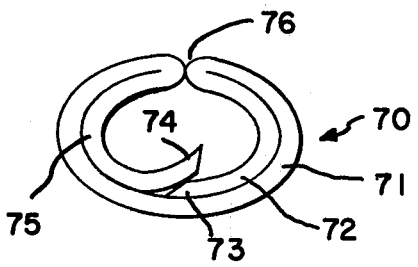
Figure 15B:
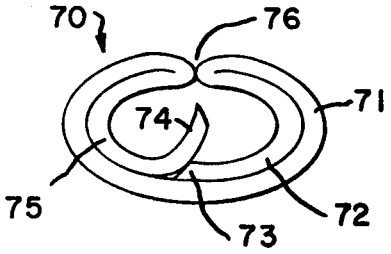
Figure 15C:
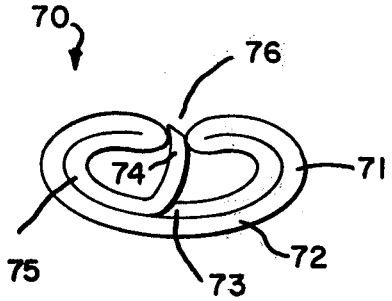

Referring now to FIGS. 15 through 15*c* there is shown a form of the invention during four stages of crimping. FIG. 15 shows the end view of the double walled barrel with the folded over inner wall defined by reference characters 72 and 75, and the outer wall defined by reference character 71. The folded over inner wall sections 72 and 75 terminate respectively in terminating end portions 73 and 74 which are formed to have opposing and parallel angled configurations, as shown in FIG. 15.

As crimping begins, the end 74 of folded over inner wall portion 75 begins to ride up and over the end 73 of inner wall portion 72 due to the angled configuration of the extreme edges of the terminating edges 74 and 73. At the same time the fold over portion 76 of the barrel 70 begins to come downwardly towards the tip 74 which is beginning to extend into the interior of the barrel 70.

In FIG. 15*b* the crimping has progressed further and the tip 74 of inner wall portion 75 is now extended well into the interior of cavity 70 and, in fact, is approaching the intersection of the fold over portion 76 of barrel 70.

In FIG. 15*c* the crimping is completed and the tip 74 is extended up and partially in between the folded over end portion 76 of barrel 70.

While the four FIGS. 15–15*c* show no wires in the barrel 70 is to be understood that a stranded wire would normally be placed in the barrel 70 before crimping began. It is also to be understood that it is not necessary to crimp to the extent shown in FIG. 15*c*. Crimping can be terminated at the degree shown in FIG. 15*a*, or, if desired, as shown in FIG. 15*b*, depending upon the application desired. For example, if crimping is terminated at the stage shown in FIG. 15*c*, the tip 74 will extend far enough into the barrel cavity to penetrate through a heavy insulation and into the metal of the conductor therein.

In the case of a bare metallic wire, either solid or stranded, for example, crimping can terminate as shown in FIG. 15*b* wherein the tip 74 has penetrated only slightly into the barrel 70 interior but sufficiently to dig into the wire to make good electrical and mechanical connection therewith.

Figure 16A:
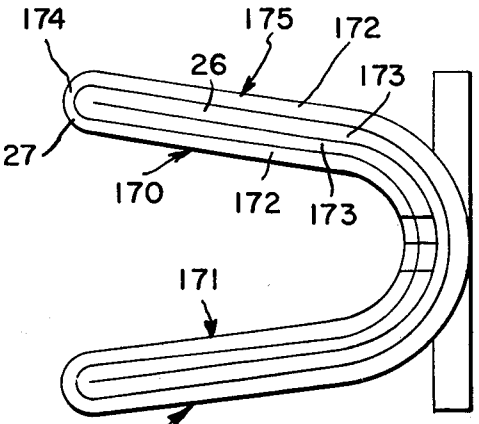
FIGS. 16 and 16*a* show a top view and an end view of another form of the invention utilizing a double walled barrel in which each wall thickness is formed of two sheets of metal bonded together to form bi-metallic walls.
Figure 16:
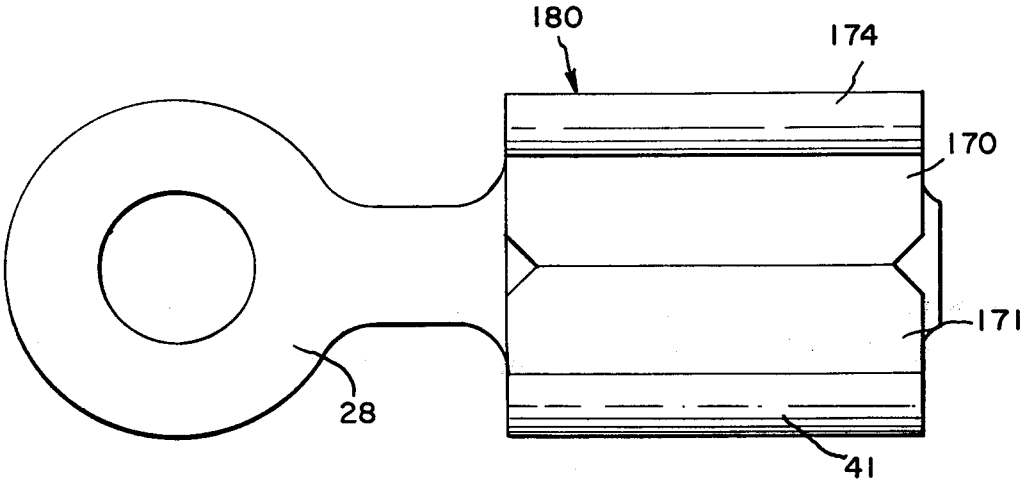

Referring now to FIGS. 16 and 16*a* there is shown a form of the invention wherein the inner and outer walls of the double walled barrel 180 are formed of a bi-metallic sheet of metal. More specifically, in FIG. 16*a* the inner walls 170 and 171 consist of two layers of metal bonded together. More specifically, consider the inner wall 170 which consists of a first layer of metal 172 and a second layer of metal 173. The first layer of metal 172 comprises the inner layer of metal (with respect to the barrel 180 cavity) for the inner wall 170 and folds around the fold edge 174 to become the outer layer of metal for the outer wall 175. The second layer of metal 173 forms the outer layer for the inner barrel wall 172 and the inner layer for the outer wall 175.

The use of the bonded bi-metallic material to form the doubled wall barrel offers unique advantages. For example, where a very high structural strength is desired, but retaining good electrical contact with the wire to be crimped therein, the inner layer of metal 173 can be of steel and the outer layer 172 can be of copper or aluminum, or any other metal suitable for the particular application involved.

In the structure of FIGS. 16 and 16*a*, the inner walls 170 and 171 can be configured in many different ways, such as having slots 181 and 182 cut therein or in other ways described and shown in the other embodiments of the invention disclosed herein.

It should be noted that configurations of the inner walls other than those shown herein can be employed in the invention. For example, the walls of the slots or apertures in the inner walls are not required to be flared outwardly from the inner cavity of the barrel. Such walls can be parallel with no flare, or they can be flared inwardly, or one can be flared outwardly and the other inwardly. The particular design and configuration of the slots or apertures or surface texture of the inner walls for any application depends upon materials employed, wall thickness, and the size and material of the wire, and other factors. All the terminals shown and described herein can be adapted to wire sizes ranging from very small to very large.

Although the description of the subject invention has been directed almost entirely to applications for electric terminals it also has other applications. More specifically, the concept can be utilized in terminals to be secured to wires or cables other than electrical current carrying wires or cables. For example, the structure of the subject invention can be utilized to terminate guide wires, ropes or even hoses.

It is to be understood that the forms of the invention shown and described herein are but preferred embodiments thereof and that many other modifications employing the folded over barrel principle will occur to those skilled in the art without departing from the spirit or scope of the invention.

We claim:

1. The combination of a single cable and a terminating means crimped around said single cable for terminating said single cable, in which said terminating means comprises:

a barrel-shaped outer wall having a convex inner surface and an open seam extending axially along the length thereof; and an inner wall adjacent to said outer wall and having a concave inner surface;

said inner wall comprising first and second sections each having inner surfaces and each having first and second oppositely positioned edges and each integrally connected at said first edge to said outer wall along one side of said open seam and folded from said open seam towards each other upon said inner surface of said outer wall;

said single cable having a perimeter with first and second portions;

said outer and inner walls crimped around first and second portions of the perimeter, respectively, of said single cable;

the inner surfaces of said first and second sections of said inner wall physically engaging said first and second portions of said single cable and pressing said first and second portions of said single cable therewithin and against each other.

2. A combination as in claim 1 in which:

said inner wall comprises a plurality of slots cut therethrough;

at least two of said slots being substantially parallel and adjacent with respect to each other.

3. A combination as in claim 2 in which the portions of said inner wall existing between adjacent slots are elongated along a direction substantially parallel to the longitudinal direction of said slots and which are bent about their elongated axes to present a sharp edge to the interior of said barrel.

4. A combination as in claim 2 in which the walls of said slots are flared outwardly from the inner surface of said inner barrel wall towards the inner surface of said outer barrel wall.

5. A combination as in claim 2 in which the second edge of at least one of said inner wall sections is bent away from the inner surface of said outer wall and into the cavity of said barrel.

6. A combination as in claim 2 in which the second edges of said inner wall sections are bent away from the inner surface of said outer wall and into the cavity of said barrel and in which major surfaces of said bent away portions face each other and are adjacent.

7. A combination as in claim 2 in which the second edges of said inner wall sections are bent away from the inner surface of said outer wall and into the cavity of said barrel and in which said bent away terminating ends are non-continuous along each of said inner wall sections but are constructed with the bent away end of a first of said inner wall sections interleaving with the non-continuous bent away end of said second inner wall section;

and in which said bent away ends of each of said first and second wall sections lie substantially in the same plane; and in which each of said bent away ends has sharp pointed elements formed thereon to penetrate into a cable crimped within said barrel.

8. A combination as in claim 1 in which the second edges of said inner wall sections are bent away from the inner surface of said outer wall and have the center portion thereof removed to form four bent away portions extending into the cavity of said barrel;

in which said four bent away portions comprise a first and second pair of said bent away portions positioned opposite each other with their surfaces facing each other and spaced apart a predetermined distance;

and in which each of said four bent away portions has a tab attached at that edge of said bent away portion facing the center of said barrel;

in which the tabs of each of said pair of bent away portions are bent towards each other to form slots which a wire can be inserted;

in which the width of at least one of said slots is constructed to be less than the diameter of said wire inserted therein; and in which the outer and inner walls of said barrel are constructed to cover the top of said slots when said barrel is crimped to lock said cable within said slots.

9. A combination as in claim 1 in which said barrel is formed from a single sheet of bi-metallic material comprised of first and second metal layers bonded together.

10. A combination as in claim 9 in which:

said inner wall comprises a plurality of slots cut therethrough;

said slots being substantially parallel with respect to each other.

11. A combination as in claim 10 in which the portions of said inner barrel existing between said adjacent slots are elongated along a direction substantially parallel to the longitudinal direction of said slots and which are bent about their elongated axes to present a sharp edge to the interior of said barrel.

12. A combination as in claim 10 in which the walls of said slots are flared outwardly from the inner surface of said inner barrel wall towards the inner surface of said outer barrel wall.

13. A combination as in claim 10 in which the second edge of at least one of said inner wall sections is bent away from the inner surface of said outer wall and into the cavity of said barrel.

14. A combination as in claim 9 in which the second edges of said inner wall sections are bent away from the inner surface of said outer wall and into the cavity of said barrel and in which the surfaces of said bent away portions face each other and are adjacent.

15. A combination as in claim 9 in which the second edges of said inner wall sections are bent away from the inner surface of said outer wall and into the cavity of said barrel and in which said bent away terminating ends are non-continuous along each of said inner wall sections but are constructed with the bent away terminating ends of a first of said inner wall layer sections interleaving with the non-continuous bent away end portions of said inner wall section;

and in which said bent away ends of each of said first and second wall sections lie substantially in the same plane; and in which each of said bent away ends has sharp pointed elements formed thereon to penetrate into a cable crimped within said barrel.

16. A combination as in claim 9 in which the second edges of said inner wall sections are bent away from the inner surface of said outer wall and have the center portion thereof removed to form four bent away portions extending into the cavity of said barrel;

in which said four bent away portions comprise a first and second pair of said bent away portions positioned opposite each other with their surfaces facing each other and spaced apart a predetermined distance;

and in which each of said four bent away portions has a tab attached at that edge of said bent away portion facing the center of said barrel;

in which the tabs of each of said pair of bent away portions are bent towards each other to form slots into which a wire can be inserted;

in which the width of at least one of said slots is constructed to be less than the diameter of said wire to be inserted therein; and in which the outer and inner walls of said barrel are constructed to cover the top of said slots when said barrel is crimped to lock said wire within said slots.

17. A combination as in claim 1 in which the axial length of said inner barrel layer is less than the actual length of said outer barrel layer.

18. A combination as in claim 17 in which said inner barrel layer has a portion thereof which is tapered away from the inner surfaces of said outer barrel layer and into the cavity of said barrel to decrease the cross-sectional area of the barrel opening.

19. A combination as in claim 18 in which said inner wall comprises at least one slot cut therethrough.

20. A combination as in claim 18 in which said inner wall layer has a plurality of apertures formed therethrough.

21. A combination as in claim 1 in which said inner wall comprises a plurality of apertures cut therethrough.

22. The combination of a single conductive cable and terminating means for terminating said single conductive cable, with said terminating means comprising:

a barrel formed from an integral sheet of metal;

said barrel having walls comprised of at least two layers of metal with adjacent layers being in contact with each other over most of at least one major surface thereof;

said at least two layers comprising an open seam outer layer with a concave inner surface and an inner layer having first and second terminating edges;

said inner layer comprising first and second extensions of said outer layer originating at the open seam thereof and which are folded over at said open seam and extend back upon the concave inner surface of said outer layer towards each other for predetermined distances;

said single conductive cable comprising a perimeter having first and second oppositely positioned portions;

said barrel being crimped around said single conductive cable;

said inner surfaces of said first and second extensions of said outer layer which form said inner layer being in physical contact with said opposite perimetric surfaces of said single conductive cable to maintain inwardly directed radial forces around the perimeter of said single conductive cable contained therebetween.

23. A combination as in claim 22 in which:

said inner layer comprises a plurality of slots cut therethrough;

said slots being substantially parallel with respect to each other.

24. A combination as in claim 23 in which the portions of said inner layer existing between adjacent slots are elongated along a direction substantially parallel to the longitudinal direction of said slots and which are bent about their elongated axes to present a sharp edge to the interior of said barrel.

25. A combination as in claim 23 in which the walls of said slots are flared outwardly from the inner surface of said inner layer towards the inner surface of said outer layer.

26. A combination as in claim 22 in which the terminating edges of at least one of said inner layer extensions are bent away from the inner surface of said outer layer and into the cavity of said barrel.

27. A combination as in claim 22 in which the terminating edges of at least one of said inner layer extensions are bent away from the inner surface of said outer layer and into the cavity of said barrel and in which the surfaces of said bent away portions face each other.

28. A combination as in claim 22 in which the terminating edges of said inner layer extensions are bent away from the inner surface of said outer layer and into the cavity of said barrel and in which the bent away terminating edges are non-continuous along each of said inner layer extensions but are constructed with the bent away terminating edge of a first of said inner layer extension interleaving with the non-continuous bent away edge of said second inner layer extension;

and in which said bent away ends of each of said first and second inner layer extensions lie substantially in the same plane; and in which each of said bent away ends has sharp pointed elements formed thereon to penetrate into conductors crimped within said barrel.

29. A combination as in claim 22 in which the terminating edges of said inner layer extensions are bent away from the inner surface of said outer layer and have the center portion thereof removed to form four bent away sections of terminating edges extending into the cavity of said barrel;

in which said four bent away sections comprise a first and second pair of said bent away sections positioned opposite each other with their surfaces facing each other and spaced apart a predetermined distance;

in which each of said four bent away sections has a tab attached at that edge thereof facing the center of said barrel;

in which the tabs of each of said pair of bent away sections are bent towards each other to form slots into which a conductor cable can be inserted;

the width of said slots being constructed to be less than the diameter of said conductor cable to be inserted therein;

the outer and inner layers of said barrel being constructed to cover the top of said slots when said barrel is crimped to lock said conductive cable within said slots.

30. A combination as in claim 22 in which said barrel is formed from a single sheet of bi-metallic material comprised of first and second metal layers bonded together.

31. A combination as in claim 30 in which:

said inner wall comprises a plurality of slots cut therethrough;

said slots being substantially parallel with respect to each other.

32. A combination as in claim 30 in which the portions of said inner barrel existing between said adjacent slots are elongated along a direction substantially parallel to the longitudinal direction of said slots and which are bent about their elongated axes to present a sharp edge to the interior of said barrel.

33. A combination as in claim 30 in which the walls of said apertures slots are flared outwardly from the inner surface of said inner layer extension towards the inner surface of said outer barrel wall layer.

34. A combination as in claim 30 in which the terminating edge of at least one of said inner wall extensions is bent away from the inner surface of said outer wall layer and into the cavity of said barrel.

35. A combination as in claim 30 in which the terminating edges of at least one of said inner wall extensions is bent away from the inner surface of said outer wall layer and into the cavity of said barrel and in which major surfaces of said bent away edges face each other.

36. A combination as in claim 30 in which the terminating edges of said inner layer extensions are bent away from the inner surface of said outer layer and into the cavity of said barrel and in which said bent away terminating edges are non-continuous along each of said inner layer extensions and are constructed with the bent away edges of a first of said inner layer extensions interleaving with the non-continuous bent away edges of said second inner layer extension;

in which said bent away edges of each of said first and second wall layer extension sections lie substantially in the same plane; and in which each of said bent away edges has sharp pointed elements formed thereon to penetrate into conductive cable crimped within said barrel.

37. A combination as in claim 30 in which the terminating edges of said inner wall layer extension are bent away from the inner surface of said outer wall layer and have the center portion thereof removed to form four bent away portions extending into the cavity of said barrel;

in which said four bent away portions comprise a first and second pair of said bent away portions positioned opposite each other with their surfaces facing each other and spaced apart a predetermined distance;

in which each of said four bent away portions has a tab attached at that edge of said bent away portion facing the center of said barrel;

in which the tabs of each of said pair of bent away portions are bent towards each other to form slots into which a wire can be inserted;

in which the width of at least one of said slots is constructed to be less than the diameter of said conductive cable to be inserted therein; and in which the outer and inner wall layers of said barrel are constructed to cover the top of said slots when said barrel is crimped to lock said conductive cable within said slots.

38. A combination as in claim 22 in which said inner wall comprises a plurality of apertures cut therethrough.

39. The combination of a single conductor and a double walled, barrel-shaped terminating means for terminating said single conductor, said double walled, barrel-shaped terminating means comprising:

an outer wall having an open seam substantially parallel to the axis of said barrel and defining the first and second circumferentially terminating edges of said outer wall; and an inner wall comprising a first section and a second section each having an outer surface and an inner surface;

said first section of said inner wall being an integral extension of said first terminating edge of said outer wall and folded back within said outer wall with its outer surface laying upon the inside surface of said outer wall and extending along said inside surface of said outer wall a predetermined distance;

said second section of said inner wall being an integral extension of said second terminating edge of said outer wall and folded back within said outer wall with its outer surface laying upon the inside surface of said outer wall and extending along the inside surface of said outer wall a second predetermined distance;

said single conductor having a perimeter with oppositely positioned surfaces;

said outer and inner walls crimped around said oppositely positioned surfaces of said single conductor with the inner surfaces of said first and second sections of said inner wall pressing against oppositely positioned surfaces of said single conductor to make electrical and mechanical contact therewith.

40. A combination as in claim 39 in which:

said inner wall comprises a plurality of slots cut therethrough;

said slots being substantially parallel with respect to each other.

41. A combination as in claim 40 in which the portions of said inner wall existing between said adjacent slots are elongated along a direction substantially parallel to the longitudinal direction of said slots and which are bent about their elongated axes to present a sharp edge to the interior of said barrel.

42. A combination as in claim 40 in which the walls of said apertures slots are flared outwardly from the inner surface of said inner barrel wall towards the inner surface of said outer barrel wall.

43. A combination as in claim 39 in which the terminating edges of at least one of said inner wall sections is bent away from the inner surface of said outer wall and into the cavity of said barrel.

44. A combination as in claim 39 in which the terminating edges of said inner wall sections are bent away from the inner surface of said outer wall layer and into the cavity of said barrel and in which the major surfaces of said bent away terminating edges face each other.

45. A combination as in claim 39 in which the terminating edges of said inner wall sections are bent away from the inner surface of said outer wall and into the cavity of said barrel and in which said bent away edges are non-continuous along each of said inner wall sections but are constructed with the bent away edges of a first of said inner wall sections interleaving with the non-continuous bent away edges of said second inner wall section;

in which said bent away edges of each of said first and second inner wall sections lie substantially in the same plane; and in which each of said bent away edges have sharp pointed elements formed thereon to penetrate into a conductor crimped within said barrel.

46. A combination as in claim 39 in which the terminating edges of said inner wall sections are bent away from the inner surface of said outer wall layer and have the center portion thereof removed to form four bent away portions extending into the cavity of said barrel;

in which said four bent away portions comprise a first and second pair of said bent away portions positioned opposite each other with their surfaces facing each other and spaced apart a predetermined distance;

in which each of said four bent away portions has a tab attached at that edge of said bent away portion facing the center of said barrel;

the tabs of each of said pair of bent away portions being bent towards each other to form slots into which a conductor can be inserted;

the width of at least one of said slots being constructed to be less than the diameter of said conductor to be inserted therein;

the outer and inner wall sections of said barrel being constructed to cover the top of said slots when said barrel is crimped to lock said conductor within said slots.

47. A combination as in claim 39 in which said barrel is formed from a stock of bi-metallic material comprised of a first and a second metal sheets bonded together.

48. A combination as in claim 47 in which:

said inner wall comprises a plurality of slots cut therethrough;

said slots being substantially parallel with respect to each other.

49. A combination as in claim 48 in which the portions of said inner barrel existing between said adjacent slots are elongated along a direction substantially parallel to the longitudinal direction of said slots and which are bent about their elongated axes to present a sharp edge to the interior of said barrel.

50. A combination as in claim 48 in which the walls of said apertures slots are flared outwardly from the inner surface of said inner wall section towards the inner surface of said outer wall.

51. A combination as in claim 47 in which the terminating edges of at least one of said inner wall sections is bent away from the inner surface of said outer wall and into the cavity of said barrel.

52. A combination as in claim 47 in which the terminating edges of said inner wall sections are bent away from the inner surface of said outer wall and into the cavity of said barrel and in which said bent away edges are adjacent each other.

53. A combination as in claim 47 in which the terminating edges of said inner wall sections are bent away from the inner surface of said outer wall and into the cavity of said barrel and in which the bent away edges are non-continuous along each of said inner wall sections but are constructed with the bent away edges of a first of said inner wall sections interleaving with the non-continuous bent away edges of said second inner wall section;

in which said bent away edges of each of said first and second wall layer extension sections lie substantially in the same plane; and in which each of said bent away portions have sharp pointed elements formed thereon to penetrate into a conductor crimped within said barrel.

54. A combination as in claim 47 in which the terminating edges of said inner wall sections are bent away from the inner surface of said outer wall and have the center portion thereof removed to form four bent away portions extending into the cavity of said barrel;

in which said four bent away portions comprise a first and second pair of bent away portions positioned opposite each other with their surfaces facing each other and spaced apart a predetermined distance;

in which each of said four bent away portions has a tab attached at that edge of said bent away portion facing the center of said barrel;

in which the tabs of each of said pair of bent away portions are bent towards each other to form slots into which a conductor can be inserted;

in which the width of said slots are constructed to be less than the diameter of said conductor to be inserted therein; and in which the outer wall and inner wall sections of said barrel are constructed to cover the top of said slots when said barrel is crimped to lock said conductor within said slots.

55. A combination as in claim 39 in which the axial length of said inner barrel layer is less than the axial length of said outer barrel layer.

56. A combination as in claim 39 in which said inner wall section has a plurality of apertures formed therethrough.

57. A combination as in claim 39 in which the axial length of said inner wall section is less than the axial length of said outer barrel layer.

58. A combination as in claim 39 in which said inner barrel wall has a portion thereof which is tapered away from the inner surfaces of said outer barrel wall and into the cavity of said barrel to decrease the cross-sectional area of the barrel opening.

59. A combination as in claim 39 in which said inner wall comprises a plurality of apertures cut therethrough.

* * * * *